US005486124A

United States Patent [19]

Wandler

[11] Patent Number: 5,486,124

[45] Date of Patent: Jan. 23, 1996

[54] RIGID PLASTIC HOOD FOR SOCKET CONTACTS

[75] Inventor: David Wandler, Lockport, Ill.

[73] Assignee: Methode Electronics, Inc., Chicago, Ill.

[21] Appl. No.: 285,900

[22] Filed: Aug. 4, 1994

[51] Int. Cl.[6] ..... H01R 13/187

[52] U.S. Cl. ..... 439/843; 439/851

[58] Field of Search ..... 439/736, 843, 439/851, 320–322, 310

[56] References Cited

U.S. PATENT DOCUMENTS

| | | | |
|---|---|---|---|
| 4,693,534 | 9/1987 | Clark | 439/276 |
| 4,900,260 | 2/1990 | Drogo | 439/321 |
| 4,938,718 | 7/1990 | Guendel | 439/680 |
| 5,030,126 | 7/1991 | Hanlon | 439/320 |
| 5,100,341 | 3/1992 | Czyz et al. | 439/447 |

FOREIGN PATENT DOCUMENTS

| | | | |
|---|---|---|---|
| 0274012 | 7/1988 | European Pat. Off. | 439/843 |
| 2835400 | 2/1980 | Germany | 439/736 |
| 3291874 | 4/1990 | Japan | 439/843 |
| 1030424 | 5/1966 | United Kingdom | 439/843 |

*Primary Examiner*—David L. Pirlot
*Assistant Examiner*—Jill Demello
*Attorney, Agent, or Firm*—Eddie L. Bishop; David L. Newman

[57] ABSTRACT

A hood, preferably constructed of rigid plastic, which is to be press-fit onto a socket contact. The socket contact is made of resilient conductive material and has fingers at one end for making a connection with a male contact pin. When the hood is pressed onto the socket contact, it covers the fingers of the socket contact along with the slits between the fingers and provides for a non-intermittent electrical connection with a male contact pin.

12 Claims, 2 Drawing Sheets

16
14
36
43
44
42
12
48
45
20
40
15
32
4
49
47
30
46
6

RIGID PLASTIC HOOD FOR SOCKET CONTACTS

BACKGROUND OF THE INVENTION

This invention pertains to a hood mounted on an electrical socket contact for preventing intermittent electrical connections, and in particular to a hood which is press-fit onto the socket contact and also providing for efficient manufacture of an associated female plug connector.

Electrical connectors which utilize socket contacts for mating with male contact pins are widely used in the electronics industry. Normally, the male contact pins extend from a male receptacle which mates to a female plug containing the socket contacts. However, when the electrical cable to either the male receptacle or female plug connector was flexed, the electrical connection between the male contact pins and the socket contacts could intermittently be broken. Thus, to prevent the electrical connection from intermittently being broken, a hood was mounted around each socket contact to provide a rigid bore of bounded diameter for connecting with the male contact pin. However, the hoods used on prior devices were constructed of stainless steel and thus had to be crimped onto the socket contact. Furthermore, since both the hood and socket contact were constructed of metal, the socket contact had to be manufactured under tolerance parameters which would result in the hood firmly fitting around the socket.

In view of the above, it is an object of the invention to eliminate the need to crimp a hood onto a socket contact.

Another object of the invention is to reduce the tolerance needed to manufacture a socket contact suitable for use with a hood.

It is also an object of the invention to reduce the cost in manufacturing electrical connectors which utilize socket contacts having hoods.

A further object of the invention is to prevent foreign objects from entering an electrical socket contact during the manufacture of an electrical connector plug.

An additional object of the invention is to limit the amount of stress on a socket contact having a hood.

SUMMARY OF THE INVENTION

In one form of the invention, a hood, preferably made of a rigid plastic, is pressed onto a socket contact. The socket contact is made of resilient conductive material with one end used for connecting to a wire conductor and the other end having fingers which form a bore adapted to received a male contact pin. When the hood is pressed onto the socket contact, it covers the fingers of the socket contact along with the slits between the fingers. In addition, the fingers are formed at an angle to cause them to slope towards each other. Therefore, the bore formed by the fingers has a variable diameter which provides for a secure fit with the male contact pin.

Various means for practicing the invention and other advantages and novel features thereof will be apparent from the following detailed description of an illustrative preferred embodiment of the invention.

BRIEF DESCRIPTION OF THE DRAWINGS

There is shown in the drawings a presently preferred embodiment of the present invention, wherein like numerals in the various figures pertain to like elements, and wherein.

DETAILED DESCRIPTION OF THE PRESENTLY PREFERRED EMBODIMENTS

Figure 1:
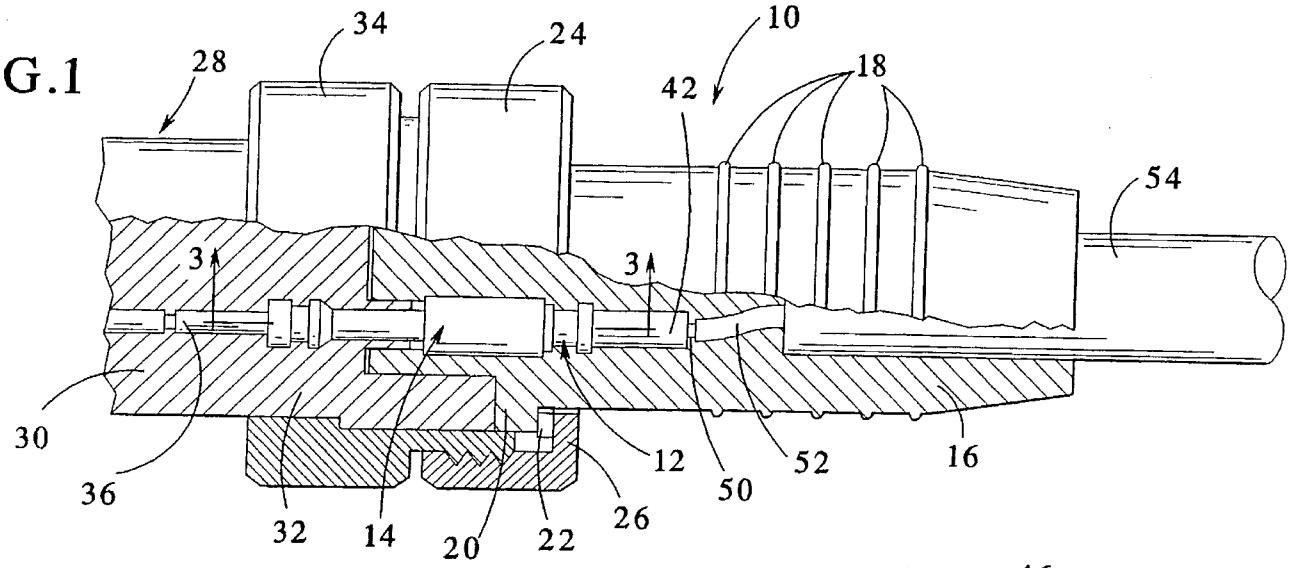
FIG. 1 is an fragmentary side elevation view of a female plug connector mated with a male receptacle.

Referring to the drawing, and particularly to FIG. 1, a female plug connector 10 is depicted with a socket contact 12 having a hood 14. The female plug connector 10 includes a boot 16 which is generally cylindrical in shape, constructed of a relatively flexible or hard elastomer, has ridges 18 on its outside surface, and has a shoulder stop 20 located at one end. Surrounding the outside of the boot 16 and adjacent to the shoulder stop 20 is an anti-friction washer 22. Also surrounding both the shoulder stop 20 and the anti-friction washer 22 is a movable coupling ring 24. The movable coupling ring 24 is generally cylindrical in shape with the inside of one end being threaded.

The anti-friction washer 22 and the movable coupling ring 24 are placed over the boot 16 after the boot has been molded. However, the movable coupling ring 24 has a lip portion 26 on one end which retains the ring on the boot 16 because the lip portion has a smaller inside diameter than either the ridges 18 or the shoulder stop 20.

The female plug connector 10 mates to a male receptacle 28. The male receptacle 28 includes a receptor body 30 which is generally cylindrical in shape and has an extending shoulder 32 located at one end. Mounted around the entire extending shoulder 32, a portion of the receptor body 30, and extending past the end of the extending shoulder is a stationary coupling ring 34. The outside of the stationary coupling ring 34 is threaded on one end. Other arrangements are also anticipated by the present invention.

Figures 3, 4, 5, 6:
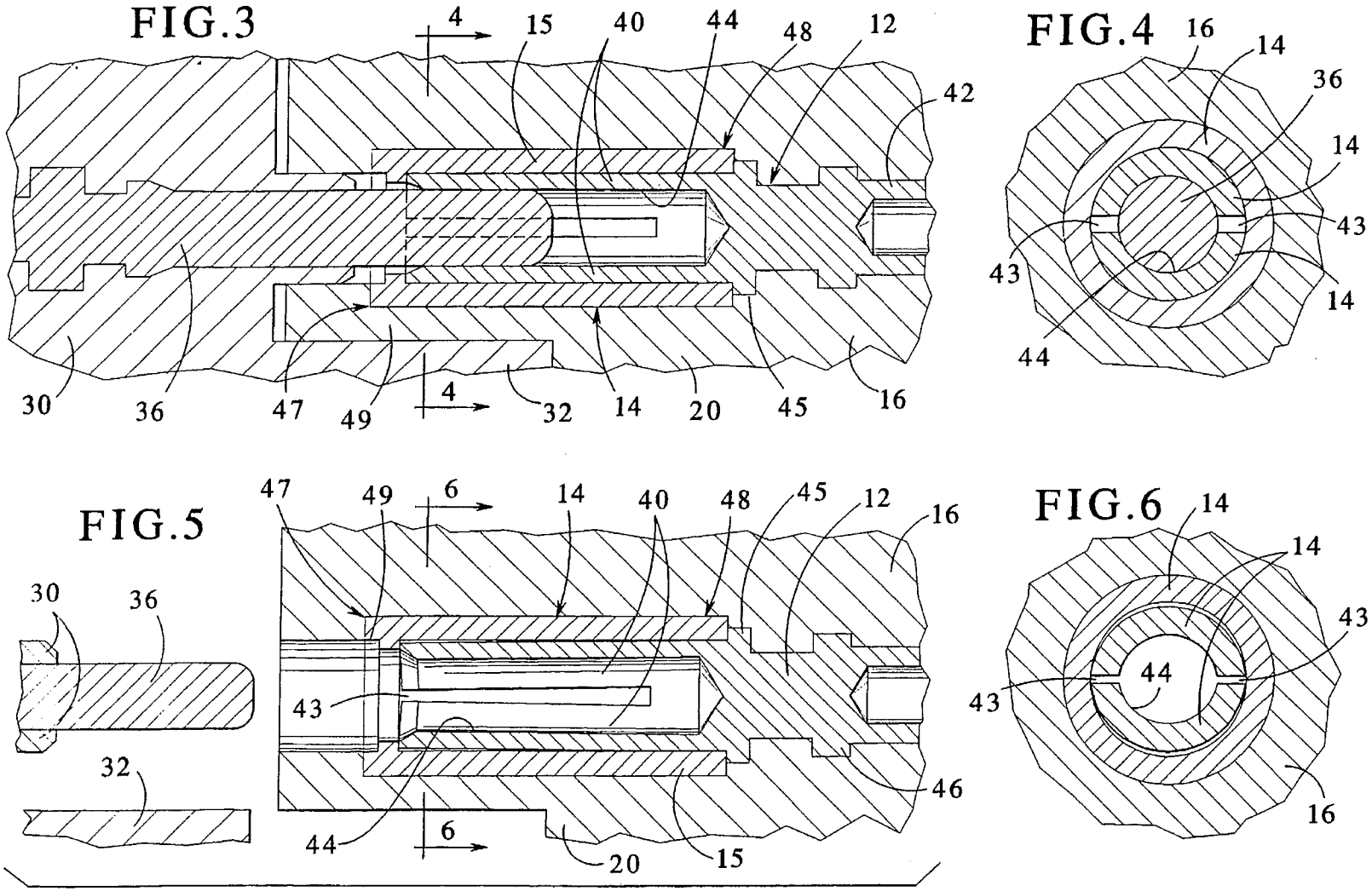
FIG. 3 is a partial cross-sectional view taken along line 3—3 of FIG. 1.
FIG. 4 is a partial cross-sectional view taken along line 4—4 of FIG. 3.
FIG. 5 is a partial cross-sectional view of FIG. 3 with the female plug connector separated from the male receptacle.
FIG. 6 is a partial cross-sectional view taken along line 6—6 of FIG. 5.

The receptor body 30 also has a male contact pin 36 extending from one end. Referring to FIG. 1, FIG. 3, and FIG. 5, the male contact pin 36 is generally cylindrical in shape with one end mounted within the receptor body 30 and the other end protruding from the receptor body 30.

Figure 2:
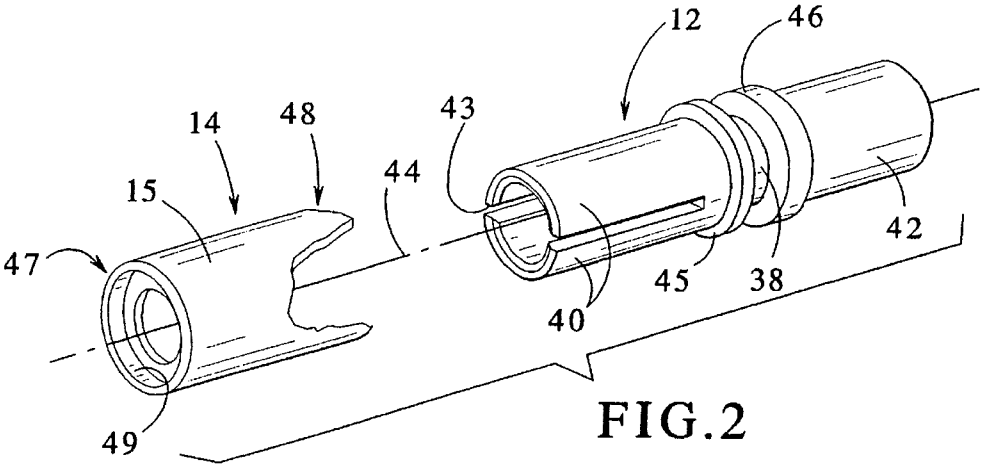
FIG. 2 is an exploded perspective view of a socket contact with a fragmentary hood assembly.

The female plug connector socket contact 12 mates with the male contact pin 36. Referring to FIG. 2, the socket contact 12 is generally cylindrical in shape and has a conductive shaft 38 with fingers 40 on one end and a tubular wire conductor receiving contact 42 on the other end. The fingers 40 are constructed so that there are slits 43 between them. The fingers 40 are also tapered by mechanically bending into a concave shape at their male contact pin-receiving ends. Furthermore, the fingers 40 form a bore 44 for receiving the male contact pin 36.

The socket contact 12 also has a hood stop ring 45 located between the conductive shaft 38 and the fingers 40. The hood stop ring 45 has a larger outer diameter than the conductive shaft 38 and the fingers 40. Furthermore, the socket contact 12 has a holding ring 46 located between the conductive shaft 38 and the wire conductor receiving contact 42. The holding ring 46 has a larger outer diameter than the conductive shaft 38 or the wire conductor receiving contact 42. In the preferred embodiment, the holding ring 46 has a larger width than the hood stop ring 45.

Mounted onto the outside of the socket contact's fingers 40 is a hood 14. The hood 14 is press-fit over the fingers 40. The hood 14 consists of a hood body 15 which is generally cylindrical in shape with a first end 47, a second end 48, and a flash ring 49 located within the hood body and adjacent to the first end. The hood body 15 and flash ring 49 are constructed of a rigid plastic. In a preferred embodiment, a glass filled polymer material such as Amodel 1133 VO manufactured by Amoco, is used. The use of a rigid plastic in the manufacture of the hood 14 permits it to accommodate being mounted onto a socket contact having a broad tolerance in the manufacture of its outer diameter. Furthermore, it has been observed that the fingers 40 of the present invention having the hood 14 press-fit thereon will reach their yield point at a much higher force compared to prior an of non-hooded contacts.

Referring to FIG. 5, when the hood 14 is press-fit onto the socket contact 12, the hood body 15 has an overall length so that the second end 48 abuts the hood stop ring 45 and the first end 47 extends past the fingers 40. The fingers 40 are sloped towards each other resulting in the width of the slits 43 to constantly decrease as they approach the male contact pin-receiving end of the fingers. The sloping of the fingers 40 toward each other also results in the inner diameter of the bore 14 to decrease when approaching the male contact pin-receiving end of the fingers 40 (See FIGS. 5 and 6).

The flash ring 49 of the hood 14 has an inner diameter which allows the male contact pin 36 to pass within and be inserted in the bore 44 formed by the fingers 40 of the socket contact 12. The flash ring 49 is positioned within the hood body 15 to prevent molding flash from inhibiting the fingers 40 from separating from each other whenever the male contact pin 36 is inserted within the bore 14. Also, the flash ring 49 will prevent any molding flash from the boot 16 from interfering with an electrical connection made between the male contact pin 36 and the fingers 40.

Referring back to FIG. 1, connected to the inside of the wire conductor receiving contact 42 of the socket contact 12 is a wire conductor 50. The portion of the wire conductor 50 that is outside of the wire conductor receiving contact 42 is surrounded by an insulative jacket 52. The conductor 50, surrounded by the insulative jacket 52, exits the female plug connector 10 through an electric cable 54 which is partially embedded within the boot 16.

It is important to note that before the boot 16 is overmolded onto the electrical cable 54, socket contact 12, and hood 14; the hood is mounted over the fingers 40 and the wire conductor 50 is attached to the wire conductor receiving contact 42. During the molding process, the hood 14 will prevent material from entering the slits 43 between the fingers 40 of the socket contact 12.

As shown in FIG. 3 and 4, when the female plug connector 10 and the male receptacle 28 are mated together, the fingers 40 of the socket contact 12 separate as the male connector pin 36 is inserted. As a result, the overall width of the slits 43 increase and the inner diameter of the bore 44 is also increases. Mating is complete when the male receptor's extending shoulder 32 abuts the boot shoulder stop 20. As shown in FIG. 1, to secure the mating, the moveable coupling ring 24 is threaded onto the stationary coupling ring 34.

As shown by the above, the variable bore 44 diameter of the socket contact 12 provides for a continuous electrical connection and secure fit regardless of external torsional forces between the male contact pin 36 and socket contact 12.

It should be understood that various changes and modifications to the presently preferred embodiments described herein will be apparent to those skilled in the art. Such changes and modifications may be made without departing from the spirit and scope of the present invention and without diminishing its attendant advantages. For example, a male connector pin 36 of any size and a corresponding socket contact 12 and hood 14 of any size may be used. Also, any number of fingers 40 may be on the socket contact 12. It is, therefore, intended that such changes and modifications be covered by the appended claims.

I claim:

1. A socket contact assembly for mating with a male contact pin, said socket contact assembly comprising:

(a) an elongated socket contact of resilient conductive material and having a forward male contact pin mating end and a rearward end, said forward end including a plurality of semi-circularly shaped fingers extending from said socket contact and forming a bore having an inner diameter; and (b) a rigid cylindrical hood disposed over the fingers and having a first end and a second end, said first end having a flash ring adjacent thereto with an opening adapted to allow insertion of said male contact pin, and said second end press-fit mounted onto said socket contact and causing said diameter of said bore to be bounded and to decrease at said forward male contact pin mating end.

2. The socket contact assembly of claim 1, wherein said ridged cylindrical hood consists of polymer material.

3. The socket contact assembly of claim 1, further comprising:

a hood stop ring mounted around said socket contact and adjacent to said hood.

4. The socket contact assembly of claim 3, further comprising:

a holding ring mounted around said socket contact between said hood stop ring and said rearward end of said socket contact.

5. A separable electrical connector including first and second connector members, one of said members being a male receptacle and the other being a female plug connector adapted to mate with said receptacle, said female plug connector including a boot and at least one socket contact mounted in said boot, said socket contact of resilient metal and having a wire receiving end and a plurality of semi-circularly shaped fingers forming a bore, said male receptacle having a male contact pin corresponding to the socket contact and adapted for engagement with the mating end of the socket contact when said male receptacle and said female plug connector are in mated relationship, said socket contact including a cylindrical shaped rigid hood surrounding the mating end of said socket contact and press-fit onto said socket contact to reduce said bore diameter, said hood also having a flash ring adjacent to said first end with an opening adapted to receive said male contact pin.

6. The connector of claim 5, which further comprises:

a hood stop ring mounted around said socket contact and adjacent to said hood.

7. The connector of claim 5, wherein said hood consists of polymer material.

8. A method of manufacturing a female plug connector boot having a socket contact, said method including the steps of:

pressing a hood onto said socket contact; and overmolding a boot around said hood and said contact socket.

9. The method of claim 8, including the steps of:

connecting a conductor to said socket contact; and overmolding the boot around the conductor.

10. The method of claim 9, including the step of overmolding around an electrical cable containing said conductor.

11. A socket contact assembly for providing continuous electrical contact with a male pin comprising:

(a) a socket contact having semi-circular shaped fingers defining a bore having a diameter; and (b) a hood press-fit onto said fingers said hood having a flash ring and said hood reducing said bore diameter wherein said male pin is frictionally received by said bore.

12. The hood of claim 11 wherein said hood body consists of polymer material.

* * * * *